US010253721B2

(12) United States Patent
Wang et al.

(10) Patent No.: US 10,253,721 B2
(45) Date of Patent: Apr. 9, 2019

(54) CYLINDER LINER FOR INTERNAL COMBUSTION ENGINE

(71) Applicant: GM GLOBAL TECHNOLOGY OPERATIONS LLC, Detroit, MI (US)

(72) Inventors: Qigui Wang, Rochester Hills, MI (US); Bhuvaneswara R Dharmavarapu, Rochester Hills, MI (US); Cherng-chi Chang, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 72 days.

(21) Appl. No.: 15/485,430

(22) Filed: Apr. 12, 2017

(65) Prior Publication Data

US 2018/0298842 A1 Oct. 18, 2018

(51) Int. Cl.

| | |
|---|---|
| ***F02F 1/00*** | (2006.01) |
| ***B22D 19/00*** | (2006.01) |
| ***F02F 1/02*** | (2006.01) |
| *F02F 1/16* | (2006.01) |
| *F04B 39/12* | (2006.01) |
| *F02B 23/06* | (2006.01) |

(52) U.S. Cl.

CPC ..... *F02F 1/004* (2013.01); *F02F 1/02* (2013.01); *B22D 19/0009* (2013.01); *F02B 2023/0612* (2013.01); *F02B 2023/0615* (2013.01); *F02F 1/16* (2013.01); *F02F 2200/06* (2013.01); *F04B 39/126* (2013.01); *F05C 2251/048* (2013.01)

(58) Field of Classification Search

CPC ..... F02F 1/004; F02F 2200/06; F02F 1/16; F02F 1/02; F04B 39/126; F02B 2023/0603; F02B 2023/0612; F02B 2023/0615; B22D 19/0009

USPC ..... 123/41.84, 668, 669, 193.2; 29/888.061

See application file for complete search history.

(56) References Cited

U.S. PATENT DOCUMENTS

| | | | | |
|---|---|---|---|---|
| 4,495,907 | A * | 1/1985 | Kamo | C23C 18/1216 123/193.2 |
| 4,921,734 | A * | 5/1990 | Thorpe | F02F 7/0087 123/193.2 |
| 6,182,629 | B1 | 2/2001 | Gobbels et al. | |
| 6,468,673 | B2 | 10/2002 | Saito | |
| 6,640,765 | B2 | 11/2003 | Land et al. | |
| 6,732,632 | B1 | 5/2004 | Grahle et al. | |
| 6,776,127 | B2 | 8/2004 | Osman | |
| 7,171,935 | B2 | 2/2007 | Komai et al. | |
| 7,172,011 | B2 | 2/2007 | Bing et al. | |
| 7,226,667 | B2 | 6/2007 | Kodama et al. | |
| 7,665,440 | B2 | 2/2010 | Holtan et al. | |
| 7,757,652 | B2 * | 7/2010 | Miyamoto | B22D 19/0009 123/193.2 |
| 7,806,098 | B2 | 10/2010 | Bing et al. | |
| 8,695,558 | B2 | 4/2014 | Reymond et al. | |
| 9,316,173 | B2 * | 4/2016 | Highum | B22D 19/0081 |
| 2003/0056645 | A1 * | 3/2003 | Land | F02F 1/004 123/193.2 |
| 2005/0161014 | A1 | 7/2005 | Komai et al. | |

(Continued)

*Primary Examiner* — Syed O Hasan

(57) ABSTRACT

A cylinder liner for an engine block includes a first engine block bonding surface, and a second engine block bonding surface that provides a lower heat transfer coefficient between the cylinder liner and an adjacent engine block material than the first engine block bonding surface. The second engine block bonding surface extends a substantial portion of the axial length of the cylinder liner.

10 Claims, 5 Drawing Sheets

(56) References Cited

U.S. PATENT DOCUMENTS

| | | | | |
|---|---|---|---|---|
| 2007/0012179 | A1* | 1/2007 | Takami | B22D 19/0009 92/171.1 |
| 2015/0122118 | A1* | 5/2015 | He | C23C 4/04 92/171.1 |
| 2016/0069248 | A1 | 3/2016 | Beyer et al. | |
| 2017/0012179 | A1* | 1/2017 | von Malm | H01L 33/501 |

* cited by examiner

CYLINDER LINER FOR INTERNAL COMBUSTION ENGINE

FIELD

The present disclosure relates to a cylinder liner for an internal combustion engine.

INTRODUCTION

This introduction generally presents the context of the disclosure. Work of the presently named inventors, to the extent it is described in this introduction, as well as aspects of the description that may not otherwise qualify as prior art at the time of filing, are neither expressly nor impliedly admitted as prior art against this disclosure.

Cylinder liners for combustion engines made from, for example, cast iron, provide improved wear resistance in engine blocks that may be formed from lightweight materials, such as, for example, an aluminum alloy. These cylinder liners may be placed within an engine block mold and the engine block material may be cast around the cylinder liners. The cylinder liners are then embedded within and define the cylinder bores within the engine block. These liners are known as a "cast in place" type of liner.

It is important to maintain a strong bond between the liner and the block to prevent the liner from moving, to prevent or resist deformation during operation, and to improve thermal conductivity between the liner and the engine block. Cylinder liners which are known to provide an excellent mechanical and thermal bond include a rough exterior surface. These liner surfaces may be referred to as having an "as-cast," "spiny," or a rough cast surface. An example of such an "as-cast" surface may provide spines, mushrooms and crevices on the outside surface of the liner. Liners including exemplary "as-cast" surfaces may be provided by various manufacturers. One exemplary manufacturer, TPR Kabushiki Kaisha, holds a trademark registration for AsLock® for a cylinder liner under which they provide a liner having an as-cast external surface. Other manufacturers providing similar cylinder liners having a similar as-cast surface include Mahle, Federal Mogul and others.

Exemplary cylinder liners having an "as-cast" surface may include surface projections which extend between about 0.3 to 0.7 millimeters in depth on the external surface of the liner and are generally produced using a centrifugal casting process. In contrast, other types of liners are typically manufactured by machining a billet cast extruded round stock bar. This results in a smooth machined external surface, rather than an "as-cast" surface and they are intended to be pressed into place in a previously cast engine block as opposed to being "cast-in-place".

Other types of interfaces between the cylinder liner and engine block have been developed such as, for example, an improved structural and thermal bond which is provided by machining special "duck-tail" shaped recessions in the inner surface of the engine block cylinder bore and then applying a cylinder liner material using a spray technique with, for example, a steel liner material. This type of interface provides an improved thermal bonding between the cylinder liner and the engine block.

A problem which has always been a challenge is the management of heat in the inter-bore section between adjacent cylinders in an engine block. There is only a very small mass of material in the engine block in the inter-bore section which is available to receive the heat being transferred into it from the combustion process occurring in the adjacent cylinders during operation of the engine. As the amount of heat in the engine block inter-bore section increases, the temperature of that material necessarily increases. This results in a potential degradation of material properties and characteristics of that engine block material. Indeed, at higher temperatures, an increase of only about 10 degrees Celsius may cause a reduction in properties of the engine block material by one half. For example, the engine block material may become soft and result in an undesirable amount of movement of the material away from the inter-bore section. This mechanism may be known as "recession" or "creep" in the industry. This movement or recession of the engine block material in the inter-bore section may result in a loss of seal between the engine block and a gasket seal and/or cylinder head. Indeed, the pressure of the cylinder head and gasket seal upon the deck surface of the engine block only tends to encourage movement of the engine block material away from the seal under the conditions where the increased temperature of the engine block material makes it increasingly susceptible to movement. This may result in an undesirable propagation of flame between adjacent cylinders and overall loss of efficiency in the combustion process.

Additionally, the movement or recession of engine block material may also induce stress into a cylinder liner and potentially alter the shape of a cylinder bore. The excellent structural bond between the as-cast cylinder liner and the engine block material means that when that engine block material recedes or moves, that moving material tends to induce a stress into the cylinder liner. In some instances, this heat related stress caused by the increased temperatures of the inter-bore engine block material may result in or encourage failure in the cylinder liner, such as by, for example, cracking of the cylinder liner.

The improved thermal conductivity provided by an as-cast cylinder liner only exacerbates the above-described problems. The amount of heat being transferred into the engine block in the inter-bore section is increased because of the improved thermal transfer provided by the increased intimacy of the as-cast cylinder liner surface with the engine block material.

One attempt at addressing and managing the heat being transferred from the cylinders into the inter-bore section of the engine block is to provide a "saw-cut" in the deck surface across the inter-bore section such that a liquid coolant may flow through the area between cooling jackets arranged around the cylinders. However, providing the saw-cuts increases the cost, undesirably adds to the complexity of manufacture, increases the stress in the liner near the saw cut, and may lead to failure and/or cracking of the liner.

Another attempt to address these issues is to ensure that the cylinder liner may extend completely to the deck face, such that recession of the engine block material in the inter-bore section and loss of seal between the engine block and the cylinder head reduces the risk of combustion chamber seal and accompanying potential flame propagation between cylinders. This type of seal is typically achieved by pressing together of hard materials, including, for example, a multiple layer steel gasket. The hardness of these materials makes sealing somewhat difficult to achieve because the materials are not readily compliant such that they easily conform to each other under pressure. This pressure may yet further encourage recession of the block material away from the seal, which may be especially vulnerable because of the increased temperatures and resultant potential loss in material characteristics in the inter-bore areas.

Yet another attempt to address these problems has been to focus upon the composition of the alloy material that is used for the engine block. However, yet again, this may only increase the cost of the alloy, introduce complexity, and risk compromise of alloy characteristics that may be useful for other purposes.

SUMMARY

In an exemplary aspect, a cylinder liner for an engine block includes a first engine block bonding surface, and a second engine block bonding surface that provides a lower heat transfer coefficient between the cylinder liner and an adjacent engine block material than the first engine block bonding surface. The second engine block bonding surface extends a substantial portion of the axial length of the cylinder liner.

In another exemplary aspect, the first engine block bonding surface extends around a substantial majority of the circumferential periphery of the cylinder liner.

In another exemplary aspect, the first engine block bonding surface includes an as-cast surface.

In another exemplary aspect, the as-cast surface includes a spiny-lock surface.

In another exemplary aspect, the as-cast surface includes a plurality of projections radially extending between about 0.3 to 0.7 millimeters.

In another exemplary aspect, the second engine block bonding surface includes a machined surface.

In another exemplary aspect, the second engine block bonding surface extends across a majority of the axial length of the liner.

In another exemplary aspect, the first engine block bonding surface provides a high thermal conductivity between the liner and the engine block and wherein the second engine block bonding surface provides a lower thermal conductivity such that heat transfer into an inter-bore section of an adjacent engine block material is reduced during operation of an engine incorporating the cylinder liner.

In another exemplary aspect, the second engine block bonding surface circumferentially extends across an area adjacent to the inter-bore section of the engine block.

In another exemplary aspect, the first engine block bonding surface extends across the remaining circumferential extent.

In this manner, the heat transfer between a cylinder and an adjacent inter-bore section is greatly reduced, thereby maintaining the desired properties and characteristics of the inter-bore engine block material and minimizing and reducing the potential for any temperature or heat related degradation of the inter-bore engine block material. This results in a significantly reduced risk of inter-bore engine block material recession that might otherwise cause a loss of seal of the cylinders that might have caused undesirable loss of combustion chamber integrity and potential flame propagation between adjacent cylinders. Further, any necessity for saw-cut and/or modification of engine block material alloy composition is obviated by the present invention. Additionally, stress may be significantly reduced in the cylinder liner also which may result in preventing or reducing the risk of liner failure and/or cracking.

Further areas of applicability of the present disclosure will become apparent from the detailed description provided below. It should be understood that the detailed description and specific examples are intended for purposes of illustration only and are not intended to limit the scope of the disclosure.

The above features and advantages, and other features and advantages, of the present invention are readily apparent from the detailed description, including the claims, and exemplary embodiments when taken in connection with the accompanying drawings.

BRIEF DESCRIPTION OF THE DRAWINGS

The present disclosure will become more fully understood from the detailed description and the accompanying drawings, wherein.

DETAILED DESCRIPTION

Figure 1:
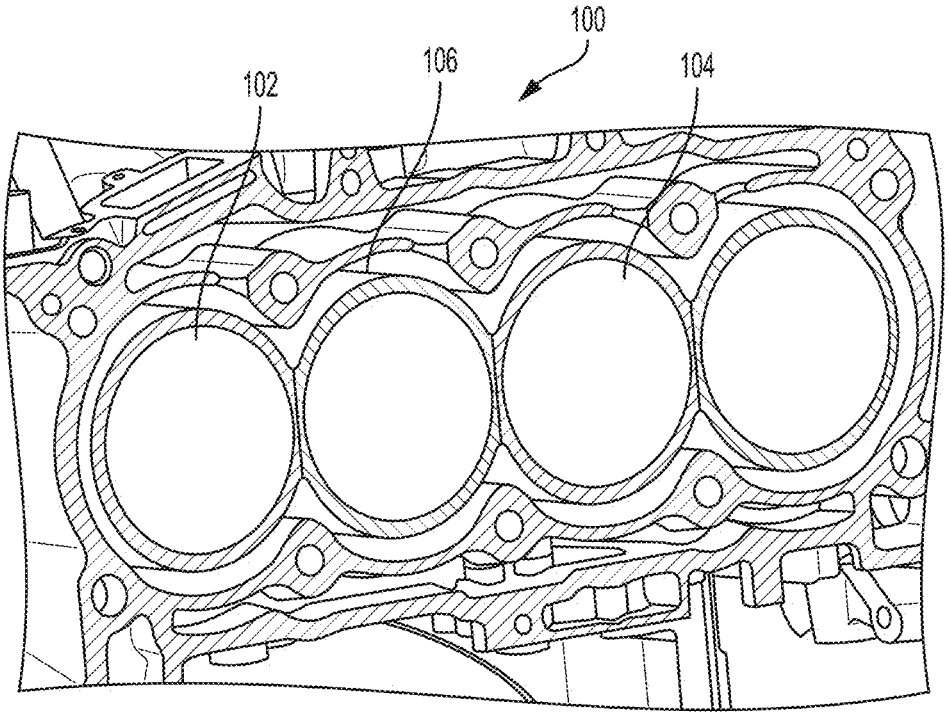
FIG. 1 is an isometric perspective view of an open deck engine block 100.

FIG. 1 illustrates an isometric perspective view of an open deck engine block 100. The engine block 100 includes a plurality of cylinder bores 102 that are defined by cylinder liners 104 which have been integrated into the engine block 100 during a casting process. In general, these cylinder liners 104 may be positioned into a mold and the molten engine block material, such as, for example, an aluminum alloy, may then be injected into the mold. The molten material then surrounds the cylinder liners as it fills the mold. The material cools to a solid and the liners are firmly bonded to the engine block material. In an exemplary process, the casting process may inject the molten engine block material under a high pressure to ensure intimate contact between the engine block material and the cylinder liner. As explained above, cylinder liners have been developed which include an "as-cast" exterior rough surface which provides an excellent structural and thermal bond through mechanical locking between the liner and the engine block material.

The engine block 100 includes a cooling fluid jacket 106 which is exposed to ("open to") the deck surface 110 and is, thus, known as an "open deck" block. The cooling fluid jacket 106 substantially surrounds the cylinder bores and provides fluid communication channels through which cooling fluid may be circulated to remove and manage heat which may be generated during a combustion process during operation of an engine incorporating the engine block 100.

Figure 2:
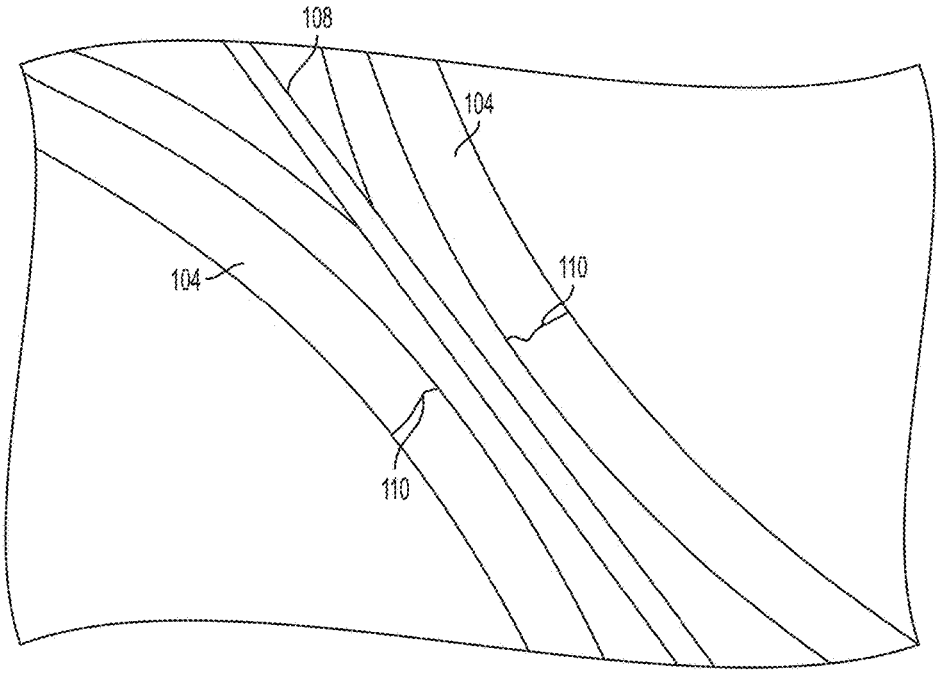
FIG. 2 is an isometric perspective view of an inter-bore portion of an engine block 100.

FIG. 2 is an isometric perspective providing a closer view of an inter-bore portion of the engine block 100 and illustrating a failure. The inter-bore is known as the portion of the engine block which is between cylinder bores. One method of improving the management and removal of heat from the cylinder bores is to provide a fluid communication channel 108 in the inter-bore section to enable a flow of fluid between cooling fluid jacket 106 sections adjacent to the inter-bore. These fluid communication channels 108 may generally be known as a "saw cut" channel and this description will refer to these channels 108 as a "saw cut" channel hereafter. While this description refers to a "saw cut" the method or tools used to create the slot in the inter-bore area of the engine block is not limited to any particular method or tool. FIG. 2 further illustrates a failure in which the cylinder liners 104 both have developed cracks 110. As explained above, these cracks 110 may have been caused by the increased temperatures of the inter-bore engine block material.

Figure 3B:
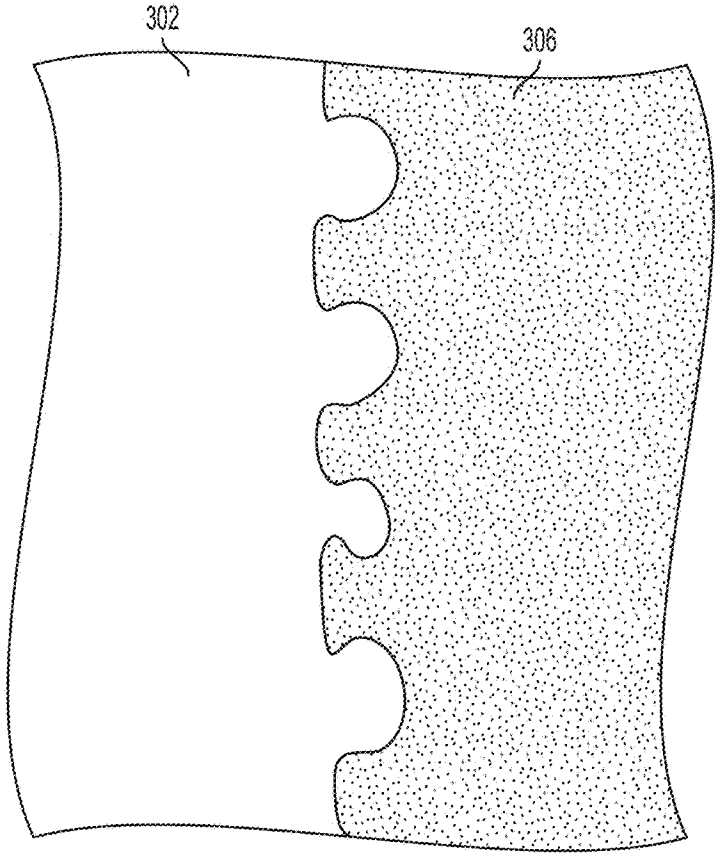
FIG. 3B illustrates a microscopic cross-sectional view of an interface between another exemplary as-cast surface cylinder liner and an engine block.
Figure 3A:
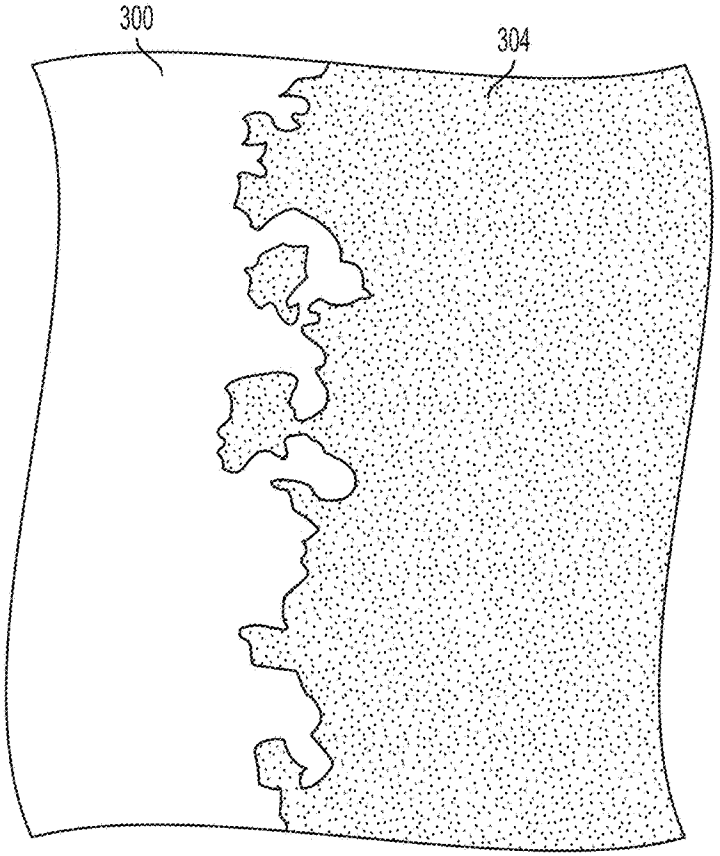
FIG. 3A illustrates a microscopic cross-sectional view of an interface between an exemplary as-cast rough surface cylinder liner and an engine block.

FIGS. 3A and 3B illustrate a microscopic view of interfaces between two exemplary as-cast rough and spiny surface cylinder liners and adjacent engine block material. In both Figures, the engine blocks are on the left and are indicated by reference numbers 300 and 302, respectively, and the cylinder liners are on the right and are indicated by reference numbers 304 and 306, respectively. FIG. 3A illustrates a cylinder liner 304 having an as-cast rough surface with a surface roughness of about 0.3 to 0.7 millimeters. FIG. 3A clearly illustrates the intimacy that results from the use of a cylinder liner having an as-cast rough surface which provides a relatively high coefficient of thermal transfer between the cylinder liner 304 and the engine block 300. FIG. 3B illustrates a cylinder liner 306 having an as-cast rough surface which may also be further characterized as having a "spiny" surface with a surface roughness of about 0.3 to 0.7 millimeters. Again, FIG. 3B illustrates an intimacy that results from the use of a cylinder liner having an as-cast rough surface which provides a relatively high coefficient of thermal transfer between the cylinder liner 306 and the engine block 302. In both of these exemplary embodiments, the cylinder liners 304 and 306 are made of a gray cast iron and the engine blocks 300 and 302 are made of an aluminum alloy. However, the present invention is not limited to any particular material for either the engine block or cylinder liner.

Figure 4B:
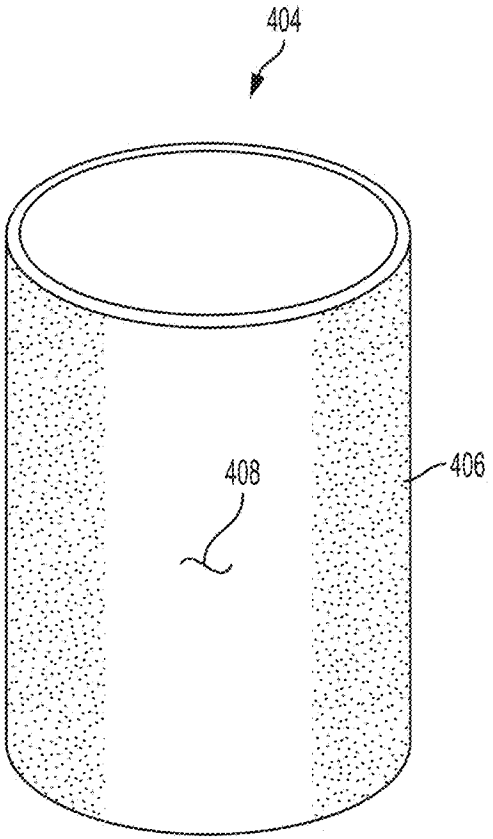
FIG. 4B is a perspective view of an exemplary cylinder liner in accordance with the present invention.
Figure 4A:
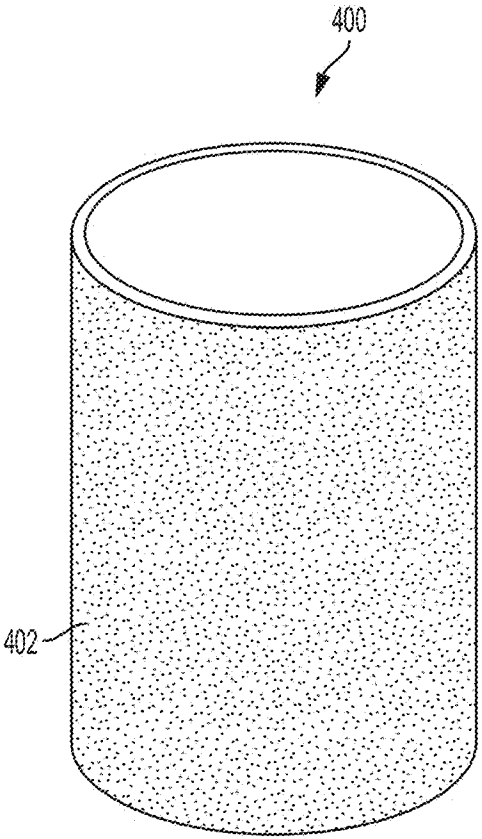
FIG. 4A is a perspective view of a conventional cylinder liner.

FIG. 4A illustrates a conventional cylinder liner 400 having an exterior surface 402 with an as-cast rough surface extending across substantially the entire exterior surface or outside diameter. In contrast, FIG. 4B illustrates an exemplary cylinder liner 404 having a first engine block bonding surface 406 and a second engine block bonding surface 408. The second engine block bonding surface 408 provides a lower heat transfer coefficient between the second engine block bonding surface 408 and an adjacent engine block material (not shown) into which the cylinder liner 404 may be cast than the heat transfer coefficient between the first engine block bonding surface 406 and an adjacent engine block material.

The second engine block bonding surface 408 extends a substantial portion of the axial length of the cylinder liner. It is to be understood that the second engine block bonding surface is not limited to any particular axial length. The extent of coverage of the second engine block bonding over the exterior surface of the cylinder liner only needs to be sufficient to reduce the thermal transfer coefficient from the cylinder bore into an inter-bore section of an engine block without limitation.

When the cylinder liner 404 is cast into an engine block, the second engine block bonding surface 408 may be oriented to be adjacent to an inter-bore section of the engine block such that the coefficient of thermal transfer between the cylinder liner 404 and the inter-bore section is less than the coefficient of thermal transfer between the cylinder liner 404 and other portions of the engine block. In this manner, the amount of heat transferred into the inter-bore section is reduced and the problems explained above, such as, for example, recession and cracking, are significantly reduced.

In the exemplary cylinder liner 404, the first engine block bonding surface 406 may extend around a substantial majority of the circumferential periphery of the cylinder liner 404. Further, in this exemplary cylinder liner 404, the first engine block bonding surface 406 is an as-cast rough surface while the second engine block bonding surface 408 may not have an as-cast rough surface.

Figure 5B:
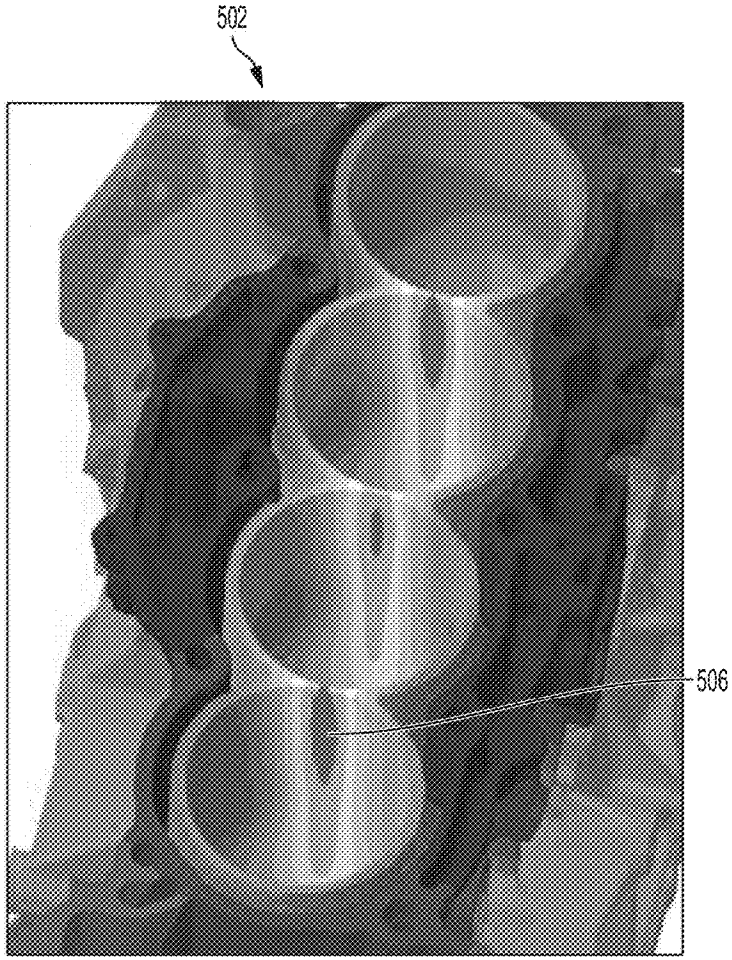
FIG. 5B is a perspective view of an engine block incorporating exemplary cylinder liners in accordance with the present invention.
Figure 5A:
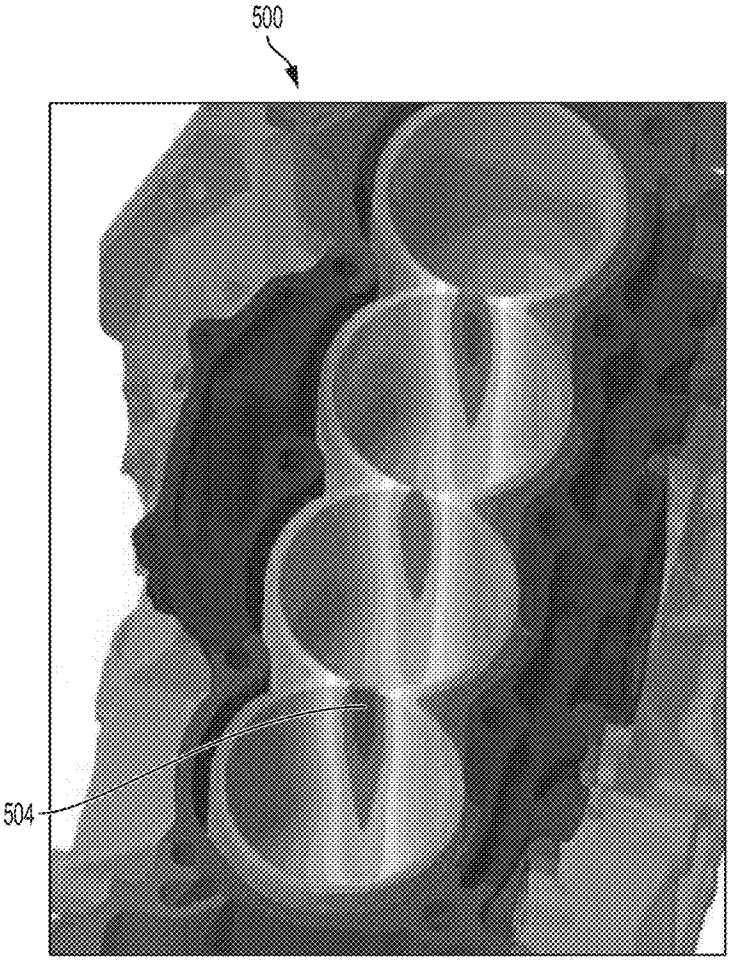
FIG. 5A is a perspective view of an engine block incorporating conventional cylinder liners.

FIGS. 5A and 5B provide perspective views of engine block 500 and 502 that, together, illustrate the reduction in the heat transfer from the cylinder bores into the inter-bore sections during operation as a result of the inventive cylinder liner. The engine block 500 includes conventional cylinder liners having an as-cast exterior rough surfaces which provide a high coefficient of thermal transfer between the cylinder bores and the engine block material in the inter-bore sections. In contrast, the engine block 502 includes cylinder liners of the present invention. In particular, the cylinder liners in the engine block 502 have a first engine block bonding surface with a higher heat transfer coefficient between the cylinder liner and the engine block material than a second engine block bonding surface that extends a substantial portion of the axial length of the cylinder liner and which is oriented adjacent to the inter-bore sections.

As is easily understood viewing FIGS. 5A and 5B, comparing the two engine blocks 500 and 502 during operation illustrates the inter-bore section 504 of the engine block 500 experiencing a higher temperature than the inter-bore section 506 of the engine block 502. In this manner, the properties of the engine block material for the engine block 502 in the inter-bore sections are not as adversely affected by higher temperatures as that of the engine block material in the engine block 500 in the inter-bore sections.

While the present description and exemplary embodiments refer to a first engine block bonding surface having an "as-cast" rough surface and a second engine block bonding surface having a machined or relatively smooth surface, it is to be understood that the present invention includes any type of surfaces so long as the coefficient of thermal transfer between the first engine block bonding surface and the engine block material is greater than that of the second engine block bonding surface and the engine block material.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A cylinder liner for an engine block, the liner comprising: a first engine block bonding surface on a first portion of an outer most engine block facing bonding surface of the cylinder liner; and a second engine block bonding surface on a second portion of the outer most engine block facing bonding surface of the cylinder liner that provides a lower heat transfer coefficient between the cylinder liner and an adjacent engine block material than the first engine block bonding surface, and wherein the second engine block bonding surface extends a substantial portion of the axial length of the outer most engine block facing bonding surface of the cylinder liner, wherein the first engine block bonding surface extends around a substantial majority of the circumferential periphery of the outer most engine block facing bonding surface of the cylinder liner, wherein the first engine block bonding surface comprises an as-cast rough surface, wherein the as-cast rough surface comprises a spiny-lock surface, wherein the second engine block bonding surface comprises a machined surface, and wherein the second engine block bonding surface extends across a majority of the axial length of the outer most engine block facing bonding surface of the cylinder liner, wherein the second engine block bonding surface circumferentially extends across an area of the outer most engine block facing bonding surface that is adjacent to the inter-bore section of the engine block.

2. The liner of claim 1, wherein the as-cast rough surface comprises a plurality of projections radially extending between about 0.3 to 0.7 millimeters.

3. An engine block comprising: an engine block material defining a plurality of cylinder bores and an inter-bore section between two of the plurality of cylinder bores; and a cylinder liner positioned within one of the cylinder bores, wherein the liner includes a first engine block bonding surface on a first portion of an outer most engine block facing bonding surface of the cylinder liner, and a second engine block bonding surface on a second portion of the outer most engine block facing bonding surface of the cylinder liner that is oriented adjacent to the inter-bore section that provides a lower heat transfer coefficient between the cylinder liner and the engine block material than the first engine block bonding surface, wherein the second engine block bonding surface extends a substantial portion of the axial length of the outer most engine block facing bonding surface of the cylinder liner, wherein the first engine block bonding surface extends around a substantial majority of the circumferential periphery of the outer most engine block facing bonding surface of the cylinder liner, wherein the first engine block bonding surface comprises an as-cast rough surface, wherein the as-cast rough surface comprises a spiny-lock surface, wherein the second engine block bonding surface comprises a machined surface, and wherein the second engine block bonding surface extends across a majority of the axial length of the outer most engine block facing bonding surface of the cylinder liner, wherein the second engine block bonding surface circumferentially extends across an area of the outer most engine block facing bonding surface that is adjacent to the inter-bore section of the engine block.

4. The engine block of claim 3, wherein the first engine block bonding surface extends around a substantial majority of the circumferential periphery of the outer most engine block facing bonding surface of the cylinder liner.

5. The engine block of claim 3, wherein the first engine block bonding surface comprises an as-cast rough surface.

6. The engine block of claim 5, wherein the as-cast rough surface comprises a spiny-lock surface.

7. The engine block of claim 3, wherein the as-cast rough surface comprises a plurality of projections radially extending between about 0.3 to 0.7 millimeters.

8. The engine block of claim 3, wherein the second engine block bonding surface comprises a machined surface.

9. The engine block of claim 3, wherein the second engine block bonding surface extends across a majority of the axial length of the outer most engine block facing bonding surface of the cylinder liner.

10. The engine block of claim 3, wherein the second engine block bonding surface circumferentially extends across an area of the outer most engine block facing bonding surface that is adjacent to the inter-bore section of the engine block.

* * * * *